US012129557B2

(12) United States Patent
Miyauchi et al.

(10) Patent No.: US 12,129,557 B2
(45) Date of Patent: Oct. 29, 2024

(54) HIGH SURFACE-PRESSURE RESISTANT COMPONENT AND PRODUCTION METHOD THEREFOR

(71) Applicants: DAIDO STEEL CO., LTD., Nagoya (JP); JATCO Ltd, Fuji (JP)

(72) Inventors: Junya Miyauchi, Nagoya (JP); Kohei Yamaguchi, Nagoya (JP); Ryohei Ishikura, Nagoya (JP); Keiichiro Kamiya, Tokyo (JP); Hiroki Terada, Tokyo (JP); Kazumasa Uchida, Fuji (JP); Yasuo Ito, Fuji (JP); Hiroaki Toyota, Fuji (JP); Shunsuke Ohshima, Fuji (JP)

(73) Assignees: DAIDO STEEL CO., LTD., Nagoya (JP); JATCO LTD, Fuji (JP)

( * ) Notice: Subject to any disclaimer, the term of this patent is extended or adjusted under 35 U.S.C. 154(b) by 687 days.

(21) Appl. No.: 17/275,123

(22) PCT Filed: Sep. 3, 2019

(86) PCT No.: PCT/JP2019/034668

§ 371 (c)(1),
(2) Date: Mar. 10, 2021

(87) PCT Pub. No.: WO2020/054522

PCT Pub. Date: Mar. 19, 2020

(65) Prior Publication Data

US 2022/0049341 A1 Feb. 17, 2022

(30) Foreign Application Priority Data

Sep. 12, 2018 (JP) ..... 2018-170941

(51) Int. Cl.

| | |
|---|---|
| ***C23C 8/22*** | (2006.01) |
| ***C21D 6/00*** | (2006.01) |
| ***C21D 8/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/48*** | (2006.01) |

(52) U.S. Cl.

CPC ..... *C23C 8/22* (2013.01); *C21D 6/004* (2013.01); *C21D 6/005* (2013.01); *C21D 6/008* (2013.01); *C21D 8/005* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/48* (2013.01)

(58) Field of Classification Search

CPC ..... C23C 8/22; C22C 38/48; C22C 38/02; C21D 8/005; C21D 8/006

See application file for complete search history.

(56) References Cited

U.S. PATENT DOCUMENTS

| | | | |
|---|---|---|---|
| 2008/0247901 | A1 | 10/2008 | Morita et al. |
| 2012/0085465 | A1 | 4/2012 | Neishi et al. |
| 2013/0288838 | A1 | 10/2013 | Kato et al. |

FOREIGN PATENT DOCUMENTS

| | | | | |
|---|---|---|---|---|
| CA | 2137744 | C | 8/1999 | |
| CN | 101285158 | A | 10/2008 | |
| CN | 102459678 | A | 5/2012 | |
| CN | 104583438 | A | 4/2015 | |
| JP | 2008-195997 | A | 8/2008 | |
| JP | 2009-068609 | A | 4/2009 | |
| JP | 2012-117102 | A | 6/2012 | |
| JP | 2013-122286 | A | 6/2013 | |
| JP | 2013-227607 | A | 11/2013 | |
| JP | 2014-070256 | A | 4/2014 | |
| WO | WO-2014034150 | A1 * | 3/2014 | ..... C21D 1/06 |

OTHER PUBLICATIONS

AlOgab, K. A., D. K. Matlock, and J. G. Speer. "Microstructural Control and Properties in Nb-Modified Carburized Steels." New Developments on Metallurgy and Applications of High Strength Steels 1 (2008).*

International Search Report (Isr) (PCT Form PCT/ISA/210), in PCT/JP2019/034668, dated Dec. 3, 2019 and English translation thereof.

Written Opinion of the International Searching Authority (WOISA) (PCT Form PCT/ISA/237), in PCT/JP2019/034668, dated Dec. 3, 2019.

Chinese Office Action, dated Sep. 3, 2021, in Chinese Application No. 201980059607.8 and English Translation thereof.

* cited by examiner

*Primary Examiner* — Jessee R Roe

(74) *Attorney, Agent, or Firm* — MCGINN I.P. LAW GROUP, PLLC

(57) ABSTRACT

A high surface-pressure resistant component includes a steel having a composition containing, in mass %, 0.17-0.23% of C, 0.80-1.00% of Si, 0.65-1.00% of Mn, 0.030% or less of P, 0.030% or less of S, 0.01-1.00% of Cu, 0.01-3.00% of Ni, and 0.80-1.00% of Cr, with the remainder being Fe and unavoidable impurities, in which the surface layer C concentration of a carburized and quenched layer is 0.70-0.80% in mass %.

2 Claims, 7 Drawing Sheets

[FIG.1]
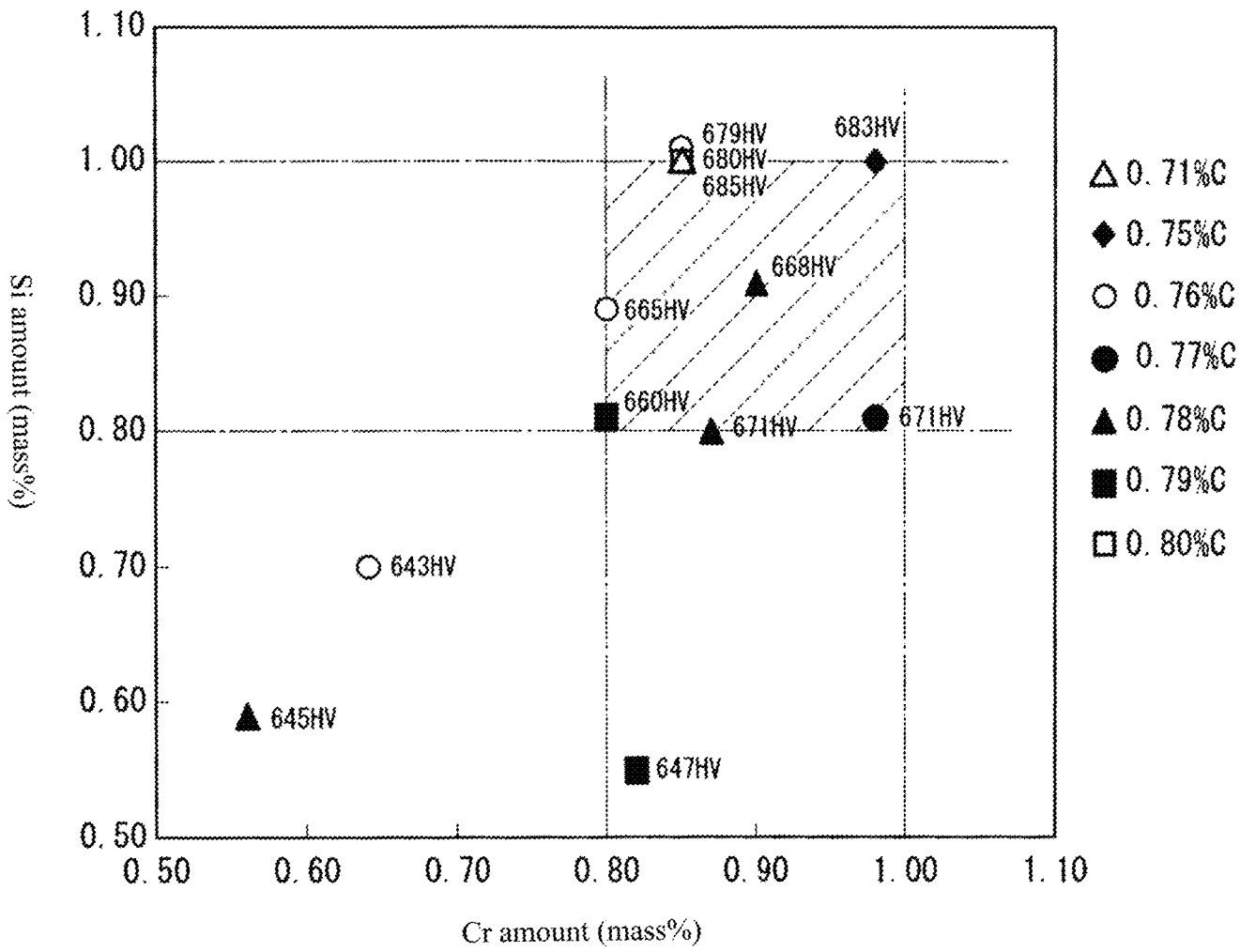

[FIG.2]
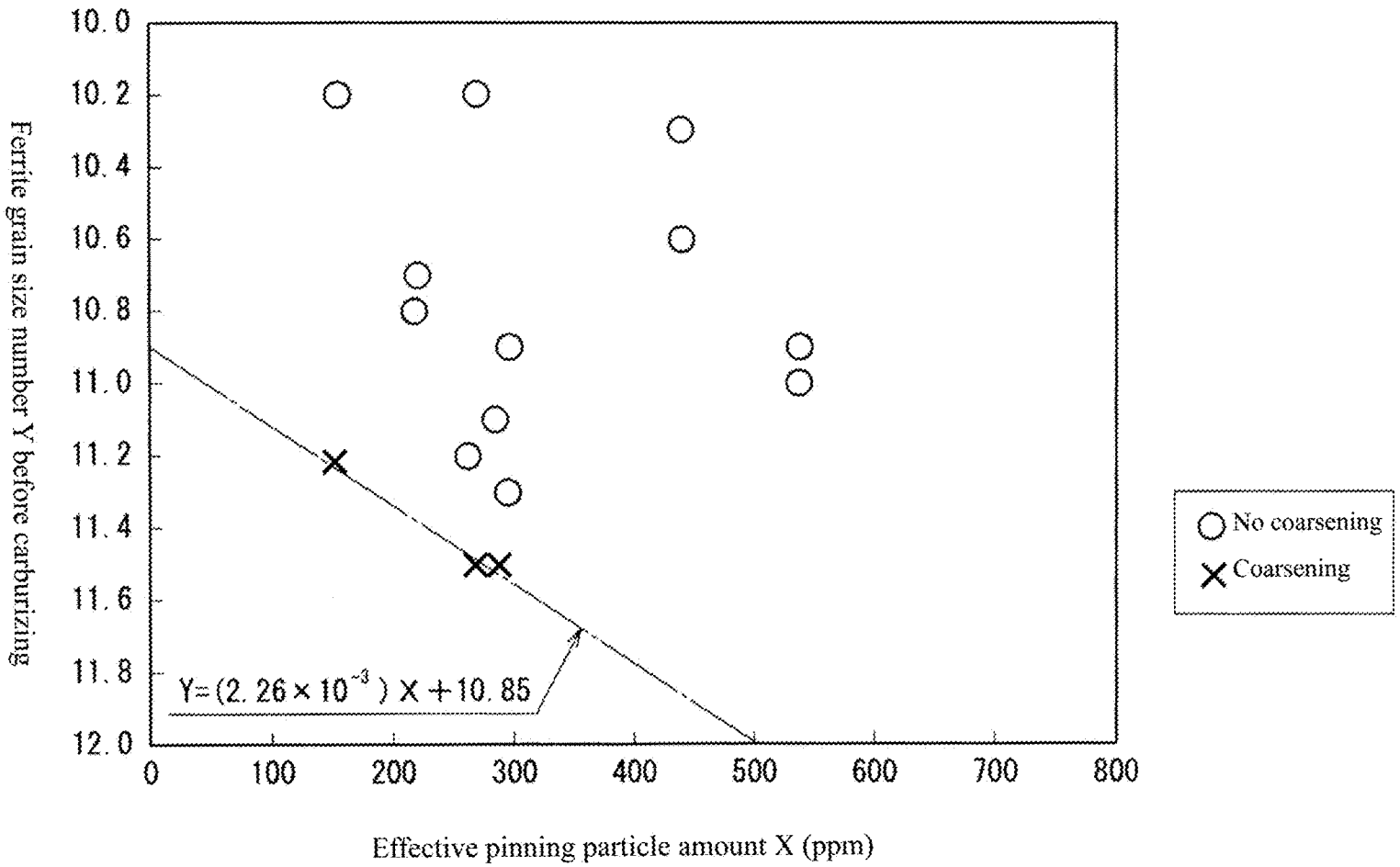

[FIG. 3]
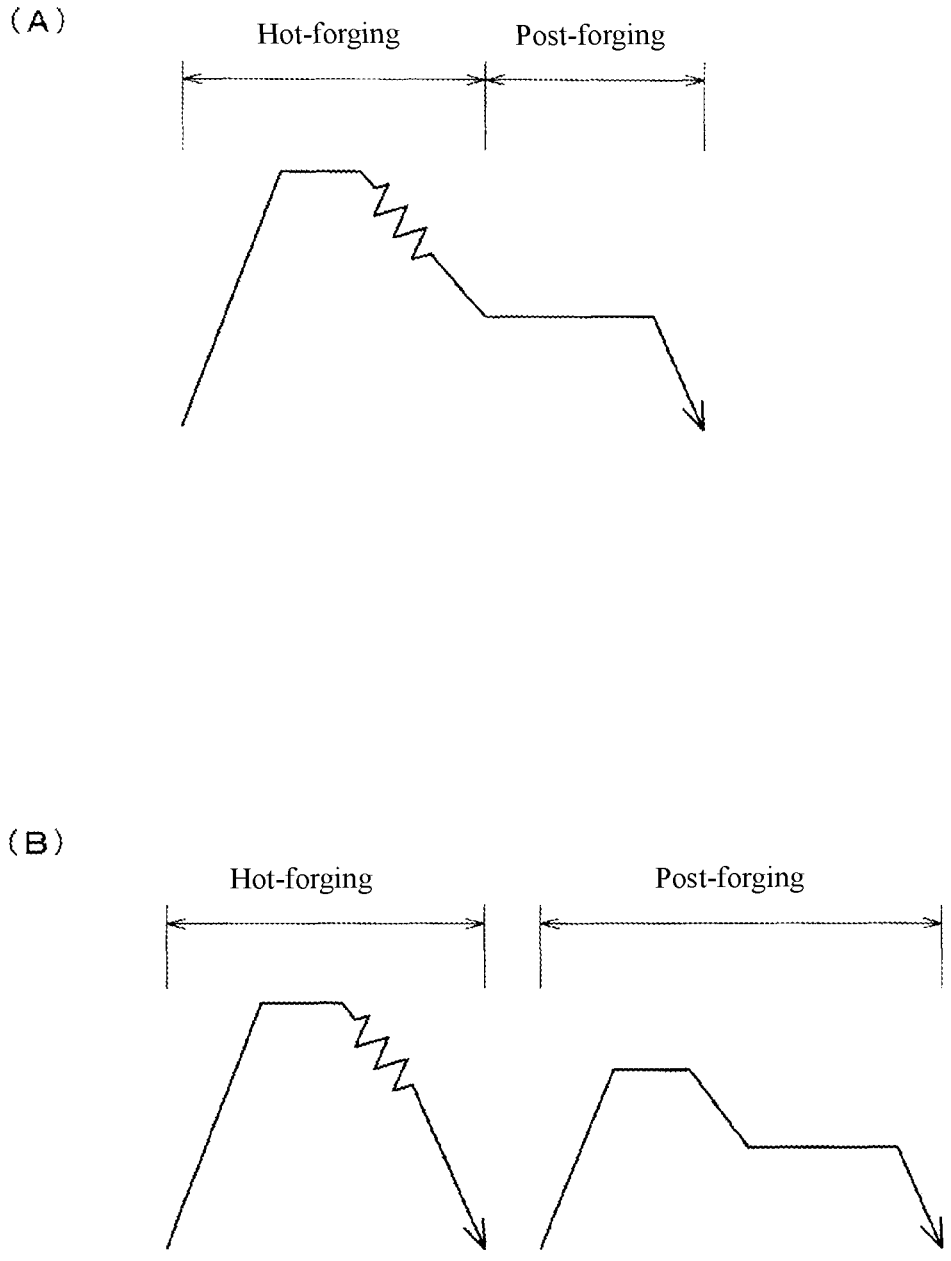

[FIG. 4]
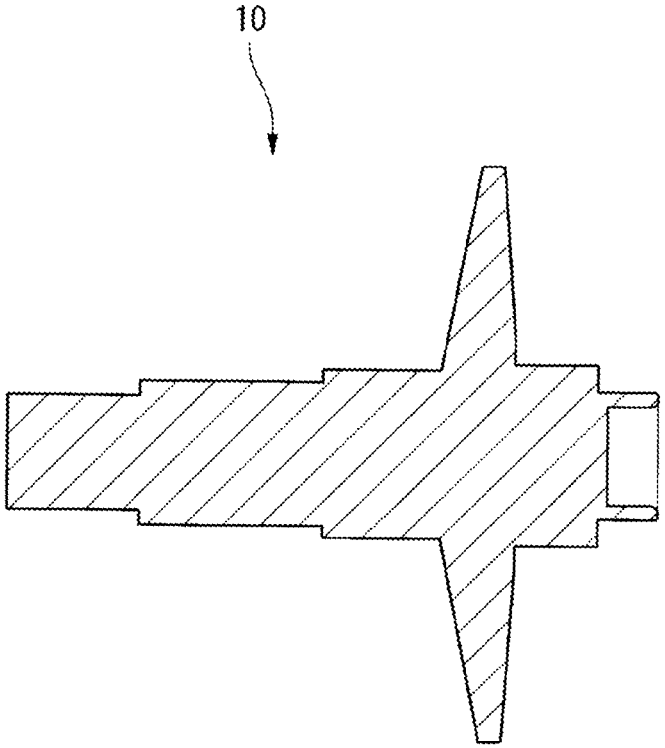

[FIG.5]
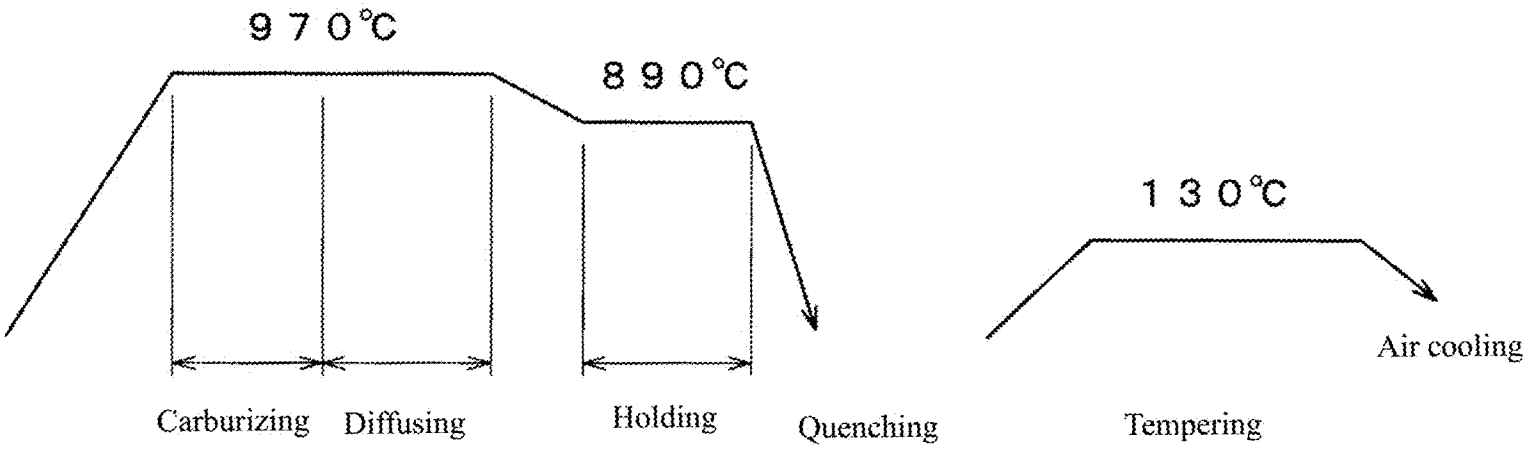

[FIG. 6]
(A)
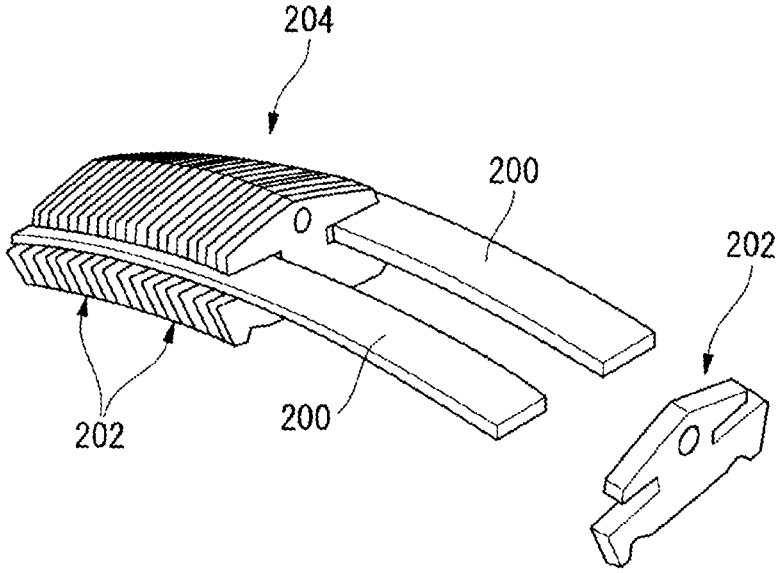
(B)
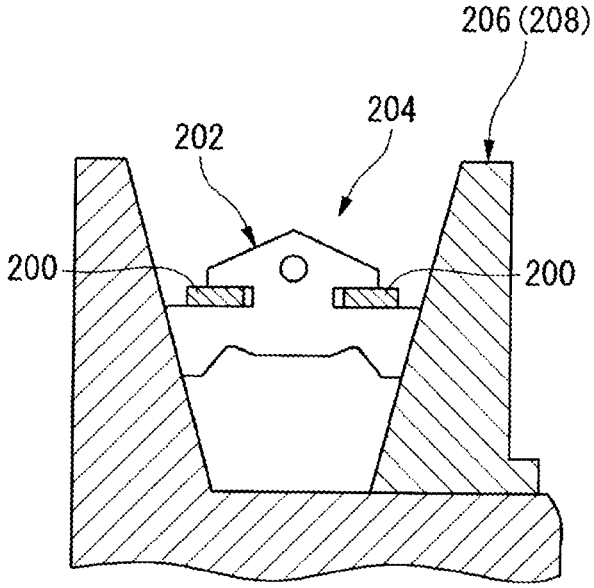

[FIG. 7]
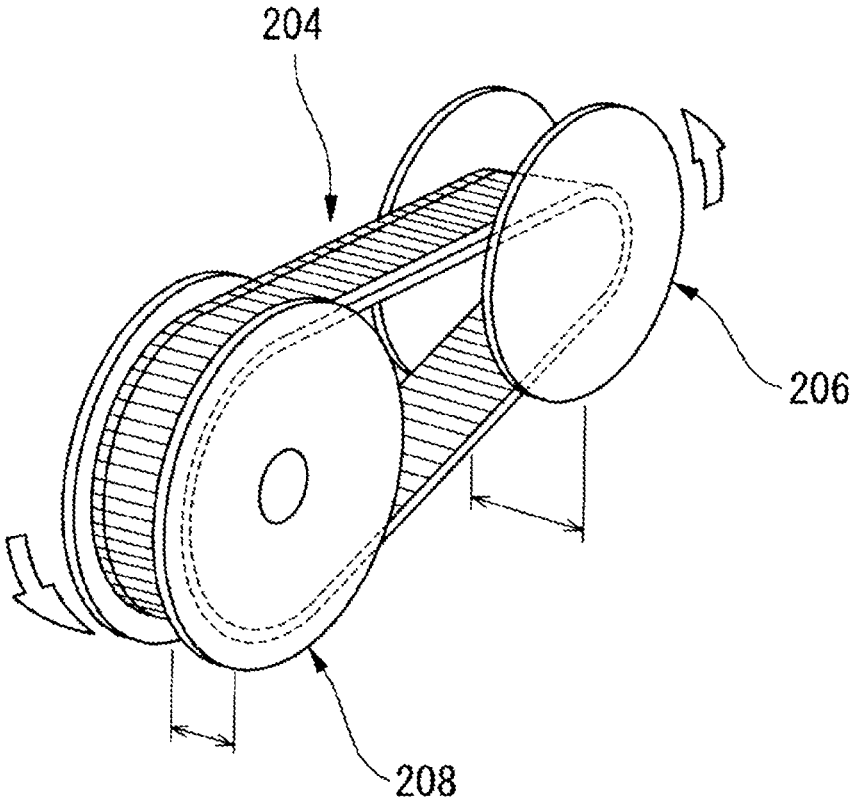

HIGH SURFACE-PRESSURE RESISTANT COMPONENT AND PRODUCTION METHOD THEREFOR

TECHNICAL FIELD

The present invention relates to a high surface-pressure resistant component used in a state in which a high surface pressure is applied, such as a belt-type CVT (belt-type continuously variable transmission) pulley, and a method of manufacturing the same.

BACKGROUND ART

In a belt-type CVT for a vehicle, a steel belt 204, which is formed by arranging and mounting a plurality of plate-shaped elements (pieces) 202 made of steel to endless annular (only a part thereof is illustrated) steel bands (metal band) 200 as illustrated in FIG. 6, is wound in an endless annular shape between a pair of pulleys (primary pulley 206 and secondary pulley 208) having variable groove widths as illustrated in FIG. 7, and power is transmitted from the primary pulley 206 to the secondary pulley 208 via the steel belt 204.

Specifically, an input from an engine enters to one pulley (primary pulley) 206, is transferred to the other pulley (secondary pulley) 208, and then is output.

At that time, by changing the groove width of each pulley, an effective diameter of each pulley is changed and shift transmission is performed steplessly and continuously.

Since a sliding surface (sheave surface) forming a groove side surface of the CVT pulley (hereinafter simply referred to as a pulley in some cases) comes into frictional contact with the element at a high surface pressure, wear easily occurs.

Therefore, a pulley, which is made by using a steel grade such as JIS SCM420, subjected to a carburizing and quenching treatment, and additionally subjected to a shot-peening treatment to improve a surface hardness, has been conventionally used (e.g., see Patent Literature 1 below).

However, there were problems in high manufacturing costs in the shot-peening treatment and damaging the sliding surface of the pulley due to remaining the used blasting material on the sliding surface as contamination.

As the related art for the present invention, the following Patent Literature 2 and Patent Literature 3 disclose that a steel material containing predetermined amounts of Si and Cr is used to enhance a high-temperature tempered hardness of the sliding surface of the pulley. However, these Patent Literatures do not disclose examples that satisfy the chemical composition of the present invention and thus, they are different from the present invention.

CITATION LIST

Patent Literature

[Patent Literature 1] JP-A-2009-68609
[Patent Literature 2] JP-A-2013-122286
[Patent Literature 3] JP-A-2014-70256

SUMMARY OF INVENTION

Technical Problem

Under these circumstances, the present invention was made with an aim to provide a high surface-pressure resistant component capable of enhancing wear resistance of a sliding surface to which a high surface pressure is applied without additionally being subjected to a shot-peening treatment, and a method of manufacturing the same.

Solution to Problem

The present invention relates to the following [1] to [3].

[1]

A high surface-pressure resistant component including a steel having a composition containing, by mass %, C: 0.17% to 0.23%, Si: 0.80% to 1.00%, Mn: 0.65% to 1.00%, P: 0.030% or less, S: 0.030% or less, Cu: 0.01% to 1.00%, Ni: 0.01% to 3.00%, Cr: 0.80% to 1.00%, and balance of Fe and inevitable impurities, in which a surface layer of a carburized and quenched layer has a C concentration of 0.70% to 0.80% by mass %.

[2]

The high surface-pressure resistant component according to [1], in which the steel further contains, by mass %: Nb: 0.045% to 0.065%, Al: 0.030% to 0.047%, and N: 0.015% to 0.030%.

[3]

A method of manufacturing a high surface-pressure resistant component, including hot-forging and machining a workpiece formed of a steel having the composition described in [2] to form into a predetermined component shape, and then performing a carburizing treatment, in which the method includes controlling component compositions and/or manufacturing conditions of the workpiece so that a relationship between an effective pinning particle amount X during the carburizing and a ferrite average grain size number Y before the carburizing satisfies the following Equation (1):

$$Y<(2.26\times10^{-3})X+10.85 \quad \text{Equation (1)}$$

here, the effective pinning particle amount X is a value (ppm) obtained by subtracting precipitation amounts of NbC and AlN after the hot-forging treatment from precipitation amounts of NbC and AlN after the carburizing treatment.

Advantageous Effects of Invention

According to the present invention, it is possible to provide a high surface-pressure resistant component capable of enhancing wear resistance of a sliding surface to which a high surface pressure is applied without additionally being subjected to a shot-peening treatment, and a method of manufacturing the same.

BRIEF DESCRIPTION OF DRAWINGS

FIG. 1 This is a diagram illustrating a relationship between a Si amount, a Cr amount and a C concentration of a surface layer in a high surface-pressure resistant component of the present invention, and a hardness after tempering at 300° C. for 3 hours.

FIG. 2 This is a diagram illustrating an influence of an effective pinning particle amount X and a ferrite average grain size number Y before carburizing on coarsening of crystal grains during carburizing.

FIG. 3 This includes diagrams for explaining a hot-forging treatment and a post-forging treatment subsequent thereto FIG. 4 This is a cross-sectional view of a test pulley.

FIG. 5 This is a diagram illustrating a heat pattern of a carburizing and quenching treatment.

FIG. 6 This includes views illustrating a steel belt of a belt-type CVT together with a steel band, an element, and the like.

FIG. 7 This is a view for explaining the belt-type CVT.

DESCRIPTION OF EMBODIMENTS

In the present invention, a C concentration of a surface layer, a Si amount and a Cr amount capable of securing a hardness of 650 Hv or more after being subjected to tempering at 300° C. for 3 hours, have been found under the findings that a fatigue lifetime of a sliding surface can be prolonged as long as the hardness of the surface layer after being subjected to tempering at 300° C. for 3 hours can be secured at 650 Hv or more, in consideration of a maximum arrival temperature of a high surface-pressure resistant component as represented by a CVT pulley in an actual environment and a time at which the maximum arrival temperature is maintained.

According to the present invention, it is possible to enhance wear resistance of the sliding surface in the high surface-pressure resistant component effectively without additionally being subjected to a shot-peening treatment.

FIG. 1 is a diagram illustrating a relationship between a Si amount, a Cr amount and a C concentration of a surface layer in a high surface-pressure resistant component of the present invention, and a hardness after tempering at 300° C. for 3 hours.

Here, used was a steel material that had a basic component of 0.22C-0.73Mn-0.15Cu-0.10Ni and varied a Si amount in a range of 0.55% to 1.05% and a Cr amount in a range of 0.55% to 1.00%.

The history of a test piece is as follows. A hot-forging material having the above-described components was subjected to a vacuum-carburizing and quenching at 970° C. for 150 minutes, and to a tempering at 130° C. for 140 minutes, and then machining was carried out to 10 mm×10 mm×15 mm Thereafter, the hot-forging material was subjected to the tempering treatment at 300° C. for 3 hours, and a hardness (Hv) of the surface layer was measured.

As illustrated in the figure, it can be seen that in the test piece where the surface layer of the carburized and quenched layer has a C concentration of 0.70% to 0.80%, when the Si amount is 0.80% or more and the Cr amount is 0.80% or more, the hardness of 650 Hv or more can be secured after tempering at 300° C. for 3 hours.

Here, since the carburizing treatment carried out to obtain a predetermined C concentration of the surface layer is a heat treatment at a high temperature for a long period of time, it may be concerned that austenite crystal grains are coarsened. The presence of abnormally grown grains in the structure due to coarsening of crystal grains causes a deterioration in strength and wear resistance.

Therefore, in the present invention, it is preferable to add a predetermined amount of Nb—Al—N to the steel. This is because a pinning effect of fine precipitates (NbC and AlN) formed of these elements can suppress the movement of austenite crystal grain boundaries and suppress grain growth during carburizing.

According to the result of research by the present inventors, NbC and AlN that have already been precipitated at a state after being subjected to the hot-forging treatment are liable to coarsen in the subsequent carburizing treatment, and the pinning effect is thus lost in some cases. Therefore, it is effective to increase an effective pinning particle amount obtained by subtracting precipitation amounts of NbC and AlN after the hot-forging treatment from precipitation amounts of NbC and AlN after the carburizing treatment.

FIG. 2 illustrates an influence of an effective pinning particle amount X and a ferrite grain size number Y before carburizing on a grain size of the austenite crystal grain during carburizing.

Here, used was a steel material that had a basic component of 0.22C-0.80~1.01Si-0.67~0.94Mn-0.15Cu-0.10Ni-0.80~0.98Cr, and varied a Nb amount in a range of 0.031% to 0.062%, an Al amount in a range of 0.029% to 0.042% and a N amount in a range of 0.011% to 0.027%.

The steel material having the above-described components was subjected to hot-forging at 1,150° C. to 1,250° C., and the precipitation amounts of NbC and AlN after the forging was examined Thereafter, machining was performed to 10 mm×10 mm×15 mm, the ferrite grain size number before carburizing was examined, a vacuum carburizing treatment was carried out at 970° C. for 150 minutes, and the presence or absence of coarsening of the prior austenite crystal grains and the precipitation amounts of NbC and AlN after the carburizing treatment were examined Extraction analysis (bromine-methanol method and electrolytic extraction method) was carried out for each of after the forging treatment and after the carburizing treatment, and an NbC extraction amount and an AlN extraction amount were quantitatively analyzed to determine the precipitation amounts of NbC and AlN. Then, a value (ppm) obtained by subtracting the precipitation amounts of NbC and AlN after the hot-forging treatment from the precipitation amounts of NbC and AlN after the carburizing treatment is taken as an effective pinning particle amount X. That is, X in Equation (1) is a value with the unit of ppm (parts per million).

The ferrite average grain size number Y before carburizing is a value obtained by measuring ferrite crystal grains with an optical microscope for 5 fields of view at magnification of 100 times in accordance with "a ferrite crystal grain size test method for steels specified in JIS G 0552", and averaging the grain size numbers.

The presence or absence of coarsening in the carburizing treatment is determined based on the following criteria, by measuring the prior austenite crystal grains with an optical microscope for 5 fields of view at magnification of 100 times in accordance with "an austenite crystal grain size test method for steels specified in JIS G 0551".

Cases where the average grain size number of the prior austenite crystal grain is 6 or more and an area ratio of coarse grains (grain size of 4.5 or less) in the observed region is less than 20% were determined that coarsening did not occur, which were marked as "○".

On the other hand, cases where the area ratio of coarse grains (grain size of 4.5 or less) in the observed region is 20% or more or cases where coarse grain having a grain size of 3 or less is present in the observed region even in a small amount, were determined that coarsening occurred, which were marked as "x".

According to FIG. 2 obtained in this manner, reducing the ferrite average grain size number Y before carburizing (increasing the ferrite grain size) and increasing of the effective pinning particle amount X are effective for suppressing the coarsening of the crystal grains during carburizing. By controlling component compositions and/or manufacturing conditions (e.g., forging heating temperature, forging termination temperature, etc.) of a workpiece so as to satisfy Equation (1) described above, that is, $Y<(2.26\times10^{-3})X+10.85$, it is possible to effectively suppress the crystal grains from coarsening during carburizing.

One of the features of the present invention is that the Si amount in the steel material is increased in order to enhance wear resistance. However, in the case of a high-Si steel material, there is a problem that a scale is easily formed on a surface thereof during hot-forging and wear of a hot-forging mold is accelerated with increase in an amount of generated scale, such that lifetime of the mold may be shortened. Particularly, in the case of a surface magnification being 5 or more, the remarkable wear occurs on the forging mold.

In such a case, it is effective to lower the forging heating temperature as a measure for extending the lifetime of the mold. Specifically, by setting the hot heating temperature to 1,165° C. or lower, the mold wear can be effectively suppressed and the lifetime of the mold can be extended.

Next, reasons for limiting each chemical component and the like in the present invention will be described in detail below.

C: 0.17% to 0.23%

C is an element necessary for securing a strength, and is contained in an amount of 0.17% or more in order to secure an internal hardness of the component. However, since machinability deteriorates as the content increases, the upper limit is set to 0.23%. Preferred is 0.20% to 0.23%.

Si: 0.80% to 1.00%

Si is an element effective for enhancing a high-temperature tempered hardness in the carburized and quenched layer. In order to obtain this effect, an addition in an amount of 0.80% or more is necessary. However, since workability deteriorates in the case of adding in an amount exceeding 1.00%, the upper limit is set to 1.00%. Preferred is 0.80% to 0.95%.

Mn: 0.65% to 1.00%

Mn is added as a deoxidizer during melting. Mn is a component useful for securing quenchability, and is contained in an amount of 0.65% or more for its function. However, since there is a concern that machinability may deteriorate as the content becomes too large, the upper limit is set to 1.00%. Preferred is 0.80% to 0.95%.

P: 0.030% or Less and S: 0.030% or Less

P and S are impurities. Since they are elements that cause embrittlement or the like and thus, are not preferable for mechanical properties of components, it is preferable that the amounts thereof are small. However, in the case where the amounts are 0.030% or less, they have insignificant effects on the characteristics, and the upper limit is set to 0.030%. Though it is preferable that no P and S are contained in the component, but in the case of containing P and S, the amounts may be, for example, 0.001% to 0.020%.

Cu: 0.01% to 1.00%

Cu is an element that improves tensile strength, an impact resistance value and fatigue strength together with Ni and Cr. The lower limit of Cu is set to 0.01% because the quenchability deteriorates and the strength deteriorates in the case where the content is smaller than that. On the other hand, the upper limit of Cu is set to 1.00% because the workability, particularly the machinability deteriorates as the content of Cu becomes too large. Preferred is 0.10% to 0.20%.

Ni: 0.01% to 3.00%

Ni is an element that improves tensile strength, an impact resistance value and fatigue strength together with Cu and Cr. The lower limit of Ni is set to 0.01% because the quenchability deteriorates and the strength deteriorates in the case where the content is smaller than that. On the other hand, the upper limit of Ni is set to 3.00% because the workability, particularly the machinability deteriorates as the content of Ni becomes too large. Preferred is 0.05% to 0.50%.

Cr: 0.80% to 1.00%

Cr is a component useful for enhancing the quenchability to secure the internal hardness. In order to secure the hardness after tempering at 300° C., it is contained in an amount of 0.80% or more. However, since there is a concern that machinability may deteriorate as the content becomes too large, the upper limit is set to 1.00%. Preferred is 0.80% to 0.98%.

C Concentration of Surface Layer: 0.70% to 0.80%

Since the C concentration of the surface layer needs to be 0.70% or more for maintaining a predetermined hardness after the heat treatment, the lower limit of the C concentration of the surface layer is defined as 0.70%. On the other hand, there is a concern that in the case where the C concentration of the surface layer exceeds 0.80%, large carbides may be generated and the wear resistance may deteriorate. Therefore, the upper limit of the C concentration of the surface layer is set to 0.80%. Preferred is 0.75% to 0.80%.

Nb: 0.045% to 0.065%

Nb has a function of forming carbides and pinning the austenite grain boundaries during carburizing. However, since the effect of suppressing the coarsening of crystal grains is saturated even in the case where an excessive amount is contained, the upper limit thereof is preferably 0.065%. More preferred is 0.046% to 0.062%.

Al: 0.030% to 0.047%

Al has a function of reacting with N in steel to form AlN and preventing the coarsening of austenite crystal grains during carburizing. In order to obtain the effect, it is preferably contained in an amount of 0.030% or more. However, since the effect of suppressing the coarsening of crystal grains is saturated even in the case where an excessive amount is contained, the upper limit is preferably 0.047%. More preferred is 0.033% to 0.042%.

N: 0.015% to 0.030%

N has a function of reacting with Al in steel to form AlN and preventing the coarsening of austenite crystal grains during carburizing. In order to obtain the effect, it is preferably contained in an amount of 0.015% or more. However, even in the case where an excessive amount is contained, the effect of suppressing the coarsening of crystal grains is saturated, and nitrides increase to cause deterioration in strength. Therefore the upper limit is preferably 0.030%. More preferred is 0.018% to 0.027%.

A high surface-pressure component according to the present invention can be manufactured by using a steel having a predetermined composition, through a manufacturing process of melting/casting→high temperature soaking (1,300° C.)→blooming→rolling of product→hot-forging→post-forging treatment→machining→carburizing and quenching→tempering→finish machining In the hot-forging process, a workpiece is once heated to 1,100° C. or higher, and then subjected to hot-forging. This takes into consideration that in hot-forging, there is a significant influence on an underfill of a material to be forged (workpiece) or forging load during forging. In addition, mold wear in hot-forging also depends on deformation resistance of the material to be forged (workpiece) during forging. In the case where the forging heating temperature is low, the deformation resistance of the material to be forged increases, and an amount of wear of a metal mold also increases. Therefore, the forging heating temperature is preferably a temperature higher than 1,100° C.

On the other hand, in this example using a high-Si steel material, there is a problem that a large amount of oxide scale is generated in the case where the forging heating temperature is high, resulting in damage of the mold, shortness of the mold lifetime, and deterioration in manufacturability. Therefore, in the case where forging is performed to obtain a shape including a portion having a surface magnification of 5 or more (portion where a lubricant which is applied on a mold surface is extensively stretched and the film of the lubricant which forms a film along the mold surface is easily cut), the forging heating temperature is preferably 1,165° C. or lower.

The post-forging treatment is a heat treatment for suppressing the formation of a bainite phase in the structure after forging. The suppression of the bainite phase is effective in securing machinability in subsequent machining and in preventing the coarsening of crystal grains during carburizing.

As illustrated in (A) of FIG. 3, the post-forging treatment can be subsequently carried out after forging. In this case, the workpiece is held at a temperature of 640° C. to 700° C. for 30 minutes or longer, and then cooled to about room temperature.

Alternatively, as illustrated in (B) of FIG. 3, the post-forging treatment can be performed on the workpiece once cooled to about room temperature. In this case, the workpiece is held at a temperature of 890° C. to 950° C. for 30 minutes or longer, then held at a temperature of 640° C. to 700° C. for 30 minutes or longer, and cooled to about room temperature.

In the case of performing the post-forging treatment subsequently to the forging as illustrated in (A) of FIG. 3, the "precipitation amounts of NbC and AlN after the hot-forging treatment" required for calculating the above-described effective pinning particle amount X indicate precipitation amounts of NbC and AlN after the post-forging treatment.

On the other hand, in the case of separately performing the forging and the post-forging treatment as illustrated in (B) of FIG. 3, they indicate precipitation amounts of NbC and AlN after the hot-forging (before post-forging treatment).

EXAMPLES

A test pulley 10 illustrated in FIG. 4 was prepared by using 15 steel grades shown in Table 1. In Table 1, in Examples 1 to 10, the amounts of each element added are within the scope of the present invention. On the other hand, in Comparative Examples 1 to 5, at least one element is out of the scope of the present invention.

TABLE 1

| | | Chemical Component (Mass %, Balance of Fe) | | | | | | | | | | |
|---|---|---|---|---|---|---|---|---|---|---|---|---|
| | | Internal C | Si | Mn | P | S | Cu | Ni | Cr | Nb | Al | N |
| Example | 1 | 0.22 | 0.80 | 0.86 | 0.010 | 0.015 | 0.15 | 0.13 | 0.87 | — | — | — |
| | 2 | 0.23 | 1.00 | 0.67 | 0.010 | 0.015 | 0.15 | 0.11 | 0.85 | — | — | — |
| | 3 | 0.23 | 0.89 | 0.68 | 0.010 | 0.014 | 0.15 | 0.13 | 0.80 | — | — | — |
| | 4 | 0.23 | 0.81 | 0.73 | 0.008 | 0.014 | 0.15 | 0.13 | 0.98 | — | — | — |
| | 5 | 0.233 | 0.91 | 0.76 | 0.008 | 0.015 | 0.15 | 0.12 | 0.90 | — | — | — |
| | 6 | 0.22 | 0.81 | 0.94 | 0.012 | 0.018 | 0.15 | 0.11 | 0.8 | 0.046 | 0.033 | 0.019 |
| | 7 | 0.23 | 1.01 | 0.8 | 0.009 | 0.018 | 0.15 | 0.11 | 0.85 | 0.062 | 0.039 | 0.018 |
| | 8 | 0.22 | 1.00 | 0.81 | 0.010 | 0.015 | 0.15 | 0.10 | 0.85 | 0.047 | 0.034 | 0.021 |
| | 9 | 0.21 | 0.91 | 0.90 | 0.011 | 0.016 | 0.15 | 0.10 | 0.90 | 0.054 | 0.035 | 0.022 |
| | 10 | 0.23 | 1.00 | 0.84 | 0.009 | 0.016 | 0.15 | 0.10 | 0.98 | 0.049 | 0.042 | 0.027 |
| Comparative Example | 1 | 0.22 | 0.59 | 1.16 | 0.012 | 0.016 | 0.15 | 0.12 | 0.56 | — | — | — |
| | 2 | 0.21 | 0.70 | 0.83 | 0.009 | 0.016 | 0.14 | 0.10 | 0.64 | — | — | — |
| | 3 | 0.22 | 0.55 | 0.90 | 0.010 | 0.017 | 0.14 | 0.10 | 0.82 | — | — | — |
| | 4 | 0.23 | 1.00 | 0.82 | 0.009 | 0.019 | 0.15 | 0.11 | 0.86 | 0.031 | 0.029 | 0.02 |
| | 5 | 0.21 | 0.72 | 0.90 | 0.012 | 0.018 | 0.15 | 0.10 | 0.60 | 0.045 | 0.035 | 0.011 |

The steel having the chemical composition shown in Table 1 was melted and cast in an ingot, followed by a homogenizing treatment of holding at 1,300° C. for 2.5 hours or longer. Thereafter, a hot-forging, a post-forging treatment, a machining, a carburizing and quenching treatment, and a tempering treatment were carried out to prepare the test pulley 10.

In the manufacturing process of the test pulley 10, a ferrite average grain size number Y before carburizing, a C concentration (%) of the surface layer after carburizing, and an effective pinning particle amount X (ppm) were examined. In addition, the presence or absence of coarsening of crystal grains in the obtained test pulley 10 was examined, and a tempering treatment at 300° C. for 3 hours was further performed and a tempered hardness was examined. These results are shown in Table 2 below.

Hot-Forging and Post-Forging Treatment

After heating the workpiece at a forging heating temperature shown in Table 2, about upper half portion and about lower half portion of the workpiece were inserted into recesses of an upper mold and a lower mold, respectively, and molded in a predetermined shape. Thereafter, subsequent to the hot-forging, the workpiece was held at a temperature of 640° C. to 700° C. for 30 minutes or longer, and then cooled to about room temperature, thereby carrying out the post-forging treatment (see (A) of FIG. 3).

Carburizing and Quenching, and Tempering

The carburizing and quenching treatment was carried out by using a vacuum carburizing furnace in the heat pattern illustrated in FIG. 5, by holding at a carburizing temperature of 970° C. for 2.5 hours, subsequently holding at a carburizing temperature of 890° C. for 0.5 hours, and then quenching by oil of 80° C. Tempering was performed by holding at 130° C. for 1.5 hours and cooling with air.

Tempering Treatment at 300° C. for 3 Hours

The test pulley 10 was put into an atmospheric furnace (which is a type of controlling the furnace temperature while actually measuring with a thermocouple) held at 300° C., and held for 3 hours from the time when the temperature, which was lowered at the time of putting, returned to 300° C.

Measurement of C Amount in Surface Layer

A sliding surface of the test pulley 10 was embedded and polish-finished, and then, a C concentration of a surface layer portion was analyzed with an electron probe micro analyzer (EPMA).

Hardness Measurement

In accordance with JIS Z 2244, the sliding surface of the test pulley 10 was mirror-polished, and a value measured at a position of 50 μm from the surface with a load of 2.94 N was used.

Measurement of Effective Pinning Particle Amount X

After the forging treatment and after the carburizing treatment, extraction analysis (bromine-methanol method and electrolytic extraction method) was carried out for the sliding surface of the test pulley 10, and an NbC extraction amount and an AlN extraction amount were quantitatively analyzed to determine the precipitation amounts of NbC and AlN. Then, a value (ppm) obtained by subtracting the precipitation amounts of NbC and AlN after the hot-forging treatment from the precipitation amounts of NbC and AlN after the carburizing treatment was taken as an effective pinning particle amount X.

Measurement of Ferrite Average Grain Size Number Y Before Carburizing

Ferrite crystal grains in the sliding surface of the test pulley 10 before carburizing (after machining) was measured by using an optical microscope for 5 field of view at magnification of 100 times in accordance with "a ferrite crystal grain size test method for steels specified in JIS G 0552", and an average value of the crystal grain size numbers was taken as a ferrite average grain size number Y.

Evaluation of Coarsening of Crystal Grains

The prior austenite crystal grains in the sliding surface of the test pulley 10 after the carburizing treatment was measured by using an optical microscope for 5 field of view at magnification of 100 times in accordance with "an austenite crystal grain size test method for steels specified in JIS G 0551", and the presence or absence of coarsening of crystal grains was evaluated based on the criteria described in paragraph 0021.

TABLE 2

| | | C % of surface layer after carburizing | Tempered hardness at 300° C. (HV) | Forging heating temperature (° C.) | Effective pinning particle amount (ppm) | Ferrite average grain size number Y before carburizing | Value on right side of Equation (1) | Coarsening after carburizing |
|---|---|---|---|---|---|---|---|---|
| Example | 1 | 0.78 | 671 | — | — | — | — | — |
| | 2 | 0.80 | 680 | — | — | — | — | — |
| | 3 | 0.76 | 665 | — | — | — | — | — |
| | 4 | 0.77 | 671 | — | — | — | — | — |
| | 5 | 0.78 | 668 | — | — | — | — | — |
| | 6 | 0.79 | 660 | 1240 | 439 | 10.3 | 11.8 | ○ |
| | 7 | 0.76 | 679 | 1140 | 295 | 11.3 | 11.5 | ○ |
| | 8 | 0.71 | 667 | 1140 | 155 | 10.2 | 11.2 | ○ |
| | 9 | 0.78 | 675 | 1240 | 537 | 10.9 | 12.1 | ○ |
| | 10 | 0.75 | 683 | 1140 | 284 | 11.1 | 11.5 | ○ |
| Comparative Example | 1 | 0.78 | 645 | — | — | — | — | — |
| | 2 | 0.76 | 643 | — | — | — | — | — |
| | 3 | 0.79 | 647 | — | — | — | — | — |
| | 4 | 0.77 | 685 | 1140 | 265 | 11.5 | 11.4 | x |
| | 5 | 0.75 | 647 | 1140 | 155 | 11.2 | 11.2 | x |

As shown in Tables 1 and 2, Comparative Example 1 has the Si amount and the Cr amount lower than the lower limit values of the present invention, and has the hardness after tempering at 300° C. lower than the target of 650 Hv.

Similarly, Comparative Example 2 has the Si amount and the Cr amount lower than the lower limit values of the present invention, and has the hardness after tempering at 300° C. lower than the target of 650 Hv.

Comparative Example 3 has the Si amount lower than the lower limit value of the present invention, and even in Comparative Example 3, the hardness after tempering at 300° C. is lower than the target of 650 Hv.

Comparative Example 4 has the Si amount and the Cr amount within the scope of the present invention, and has the hardness after tempering at 300° C. satisfying the target. However, the Nb amount and Al amount, which were added in order to prevent the coarsening, are lower than the lower limit values of the present invention. Furthermore, in Comparative Example 4, since the forging heating temperature was relatively low at 1,140° C., the ferrite crystal grain size number Y before carburizing became large (grain size was small). As a result, the relationship between the effective pinning particle amount X and the ferrite average grain size number Y before carburizing did not satisfy Equation (1) of the present invention, and the coarsening of the crystal grains was thus observed in the carburizing treatment.

Comparative Example 5 has the Si amount and the Cr amount lower than the lower limit values of the present invention. Therefore, the hardness after tempering at 300° C. is lower than the target of 650 Hv. In Comparative Example 5, although Nb, Al and N were added, the N amount is lower than the lower limit value of the present invention. Therefore, the relationship between the effective pinning particle amount X and the ferrite average grain size number Y before carburizing did not satisfy Equation (1) of the present invention, and the coarsening of the crystal grains was thus observed in the carburizing treatment.

On the other hand, all of Examples 1 to 10 in which the chemical composition and the C concentration of the surface layer satisfy the conditions of the present invention satisfy the target hardness of 650 Hv or more after tempering at 300° C. In addition, for Examples 6 to 10 in which Nb, Al and N were added within the ranges of the present invention, and the relationship between the effective pinning particle amount X and the ferrite average grain size number Y before carburizing satisfies Equation (1) of the present invention, the coarsening was not observed in the carburizing treatment, and it can be seen that the problem in coarsening of the austenite crystal grains during carburizing can be solved.

Although the present invention has been described in detail above, the present invention is not limited to the above-described Examples, and various modifications can be made without departing from the spirit of the present invention.

INDUSTRIAL APPLICABILITY

According to the present invention, it is possible to provide a high surface-pressure resistant component capable of enhancing wear resistance of a sliding surface to which a high surface pressure is applied without additionally being subjected to a shot-peening treatment, and a method of manufacturing the same.

This application is based on Japanese Patent Application (No. 2018-170941), filed on Sep. 12, 2018, the entire contents of which are incorporated herein by reference.

REFERENCE SIGNS LIST

10 test pulley
200 steel band (metal band)
202 element (piece)
204 steel belt
206 primary pulley
208 secondary pulley

The invention claimed is:

1. A surface-pressure resistant component, comprising:
a steel having a composition comprising, by mass %,
C: 0.17% to 0.23%,
Si: 0.81% to 1.00%,
Mn: 0.65% to 1.00%,
P: 0.030% or less,
S: 0.030% or less,
Cu: 0.01% to 1.00%,
Ni: 0.01% to 3.00%,
Cr: 0.80% to 1.00%, and
balance of Fe and inevitable impurities,
wherein a surface layer of a carburized and quenched layer has a C concentration of 0.70% to 0.80% by mass %.

2. The high surface-pressure resistant component according to claim 1,
wherein the steel further comprises, by mass %,
Nb: 0.045% to 0.065%,
Al: 0.030% to 0.047% and
N: 0.015% to 0.030%.

* * * * *